US007041924B2

(12) United States Patent
Jeschke et al.

(10) Patent No.: US 7,041,924 B2
(45) Date of Patent: May 9, 2006

(54) HOUSING FOR AN ELECTRONIC KEY

(75) Inventors: Alexander Jeschke, Wuppertal (DE); Günther Böhm, Walting (DE); Thomas Klotz, München (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 227 days.

(21) Appl. No.: 10/468,928

(22) PCT Filed: Apr. 13, 2002

(86) PCT No.: PCT/EP02/04125

§ 371 (c)(1),
(2), (4) Date: Aug. 21, 2003

(87) PCT Pub. No.: WO02/091309

PCT Pub. Date: Nov. 14, 2002

(65) Prior Publication Data

US 2004/0069658 A1 Apr. 15, 2004

(30) Foreign Application Priority Data

Apr. 28, 2001 (DE) ..... 101 21 045

(51) Int. Cl.
*H01H 13/06* (2006.01)

(52) U.S. Cl. ..... 200/302.2; 200/512; 200/341

(58) Field of Classification Search ..... 200/5 A, 200/512, 517, 301.1, 302.2, 296, 511, 303, 200/341, 345; 341/22, 176
See application file for complete search history.

(56) References Cited

U.S. PATENT DOCUMENTS

| | | | | |
|---|---|---|---|---|
| 4,298,778 | A * | 11/1981 | Beresford-Jones | 200/302.2 |
| 4,352,968 | A * | 10/1982 | Pounds | 200/302.2 |
| 4,421,966 | A * | 12/1983 | Pounds | 200/309 |
| 5,260,532 | A * | 11/1993 | Tinder et al. | 200/302.1 |
| 5,382,767 | A * | 1/1995 | Takano et al. | 200/531 |
| 5,746,307 | A * | 5/1998 | Joss et al. | 200/303 |
| 6,462,291 | B1 * | 10/2002 | Sachs | 200/302.2 |

FOREIGN PATENT DOCUMENTS

| | | |
|---|---|---|
| DE | 196 05 201 A1 | 8/1997 |
| DE | 199 64 166 C1 | 8/2001 |
| WO | 9955990 | 11/1999 |

* cited by examiner

*Primary Examiner*—Michael A. Friedhofer
(74) *Attorney, Agent, or Firm*—Friedrich Kueffner

(57) ABSTRACT

The invention relates to a housing (10) for a key, especially for use in motor vehicles. Said housing consists of electric and electronic components (32) disposed therein and arranged at least partially on a plate (31); a recess which can be covered by an elastic keypad (14) comprising at least one key (15). According to the invention, a support (21) is associated with the keypad (14) for retention on said housing (10). The keypad (14) surrounds the support (21) which is disposed beneath the keypad with a peripheral edge (19), whereby the elastic edge (19) is supported on a shoulder (28) of the housing (10) and the edge (19) is pressed against the shoulder (28) of said housing in a sealing manner by retaining means (24, 25).

17 Claims, 3 Drawing Sheets

FIG. 2
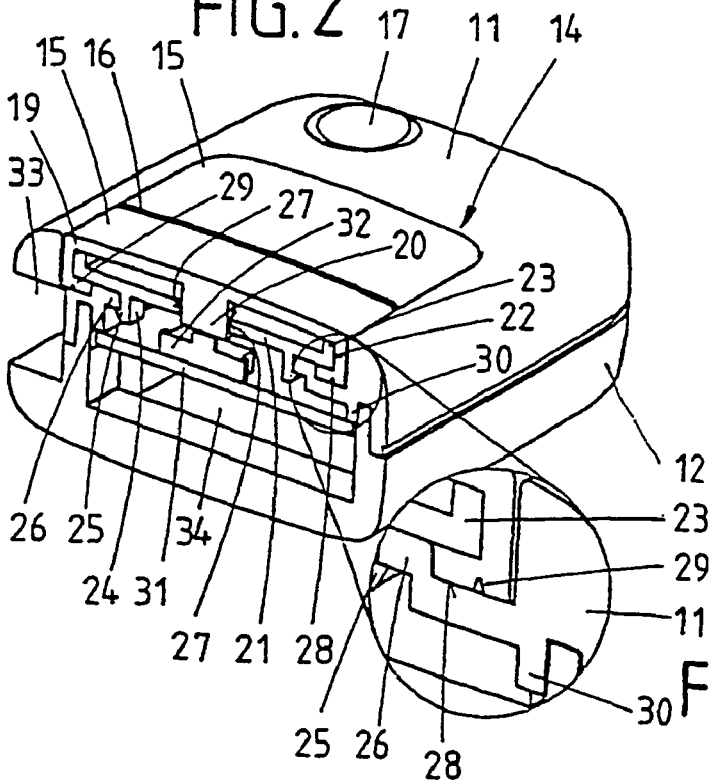
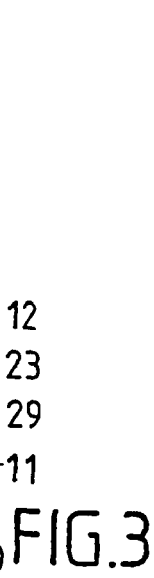
FIG. 3
FIG. 4
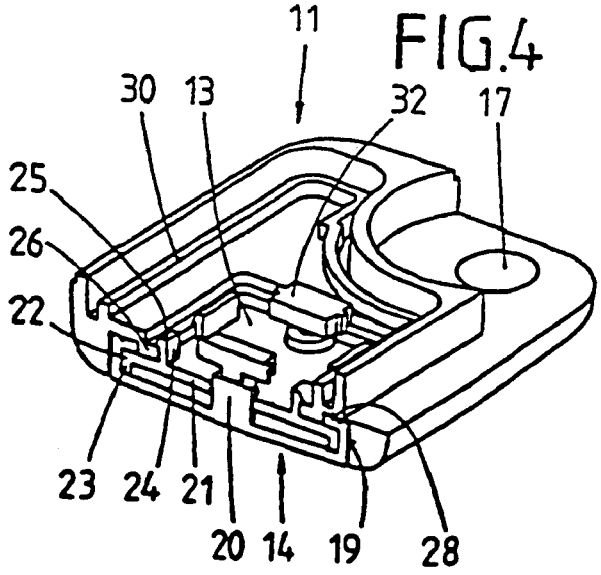

FIG.6
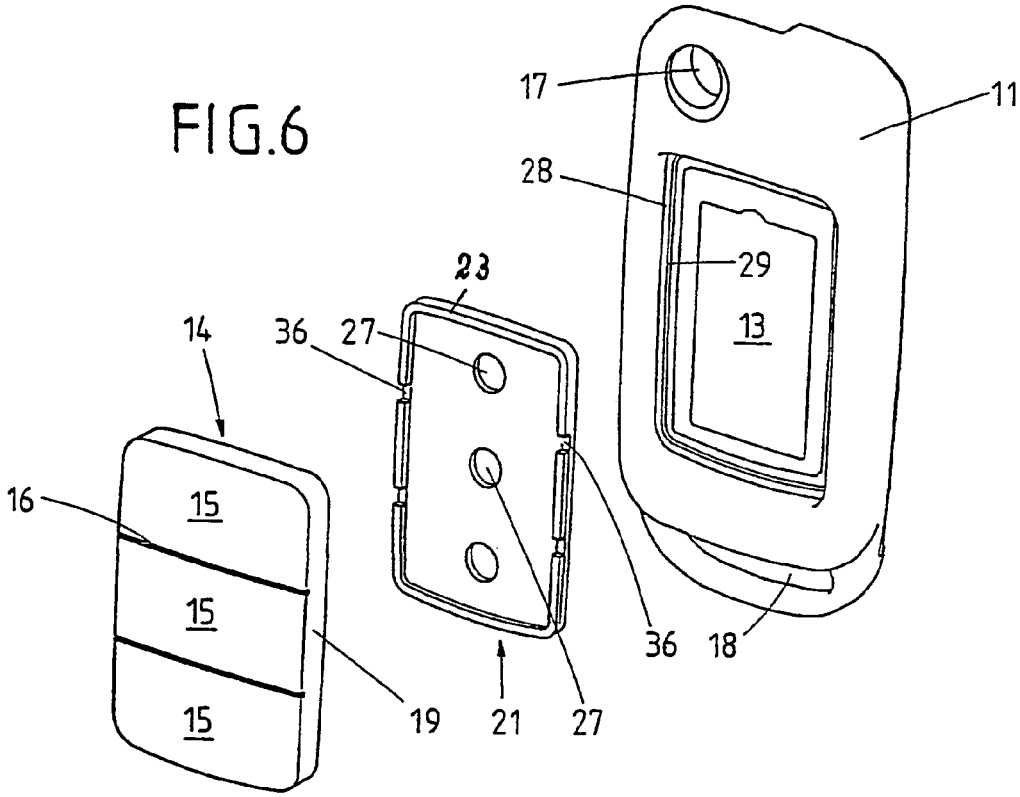
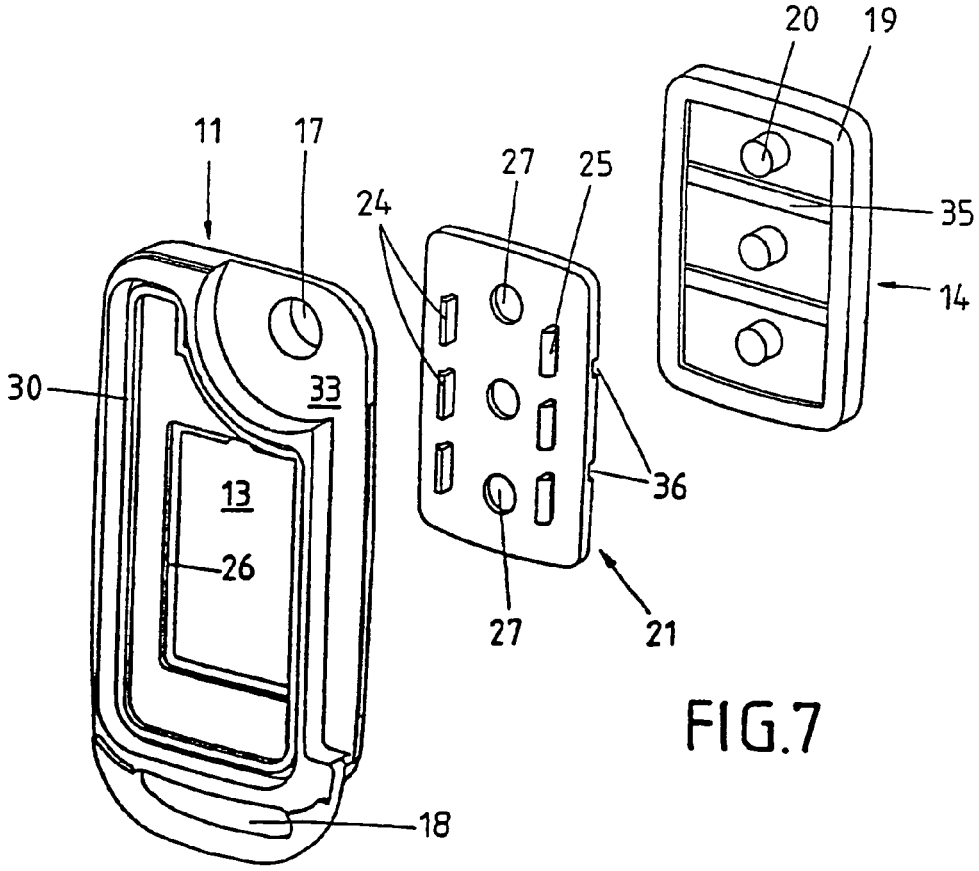
FIG.7

HOUSING FOR AN ELECTRONIC KEY

BACKGROUND OF THE INVENTION

1. Field of the Invention

The invention concerns a housing for an electronic key, especially for use in motor vehicles, with electrical and electronic components inside the housing, at least some of which are arranged on a mounting plate, and with an opening in the housing, which can be covered by an elastic keypad with at least one key. In this regard, on its side facing the mounting plate, the key is provided with an extension, by which a component on the mounting plate that is designed as a switching element can be operated.

2. Description of the Related Art

Keys of this type are being used more and more nowadays to facilitate the opening and closing of a vehicle and/or the trunk of a vehicle. However, housings of this type have the disadvantages that they are not user-friendly, that the sealing by the operating parts is inadequate, or that the cost of production and/or assembly is too great.

SUMMARY OF THE INVENTION

The object of the invention is to provide the key housing with an optimum seal and to give it an improved look and feel and at the same time guarantee perfect operation.

In accordance with the invention, this object is achieved with a housing in which the keypad has a peripheral edge that grips the underside of the support lying below the keypad, and in which the elastic edge is supported on a shoulder of the housing, such that the edge is compressed against the shoulder of the housing by retaining devices to produce a tight seal. As a result of the elastic keypad, which is directly attached to a support and is fastened to the support on the housing to produce a tight seal, a reliable and easily assembled unit is obtained, which has a very nice appearance and can be reliably operated because of its good feel. The compression of the edge of the keypad significantly improves the seal, so that a tight seal is obtained all around the edge. Contaminants or liquids cannot get into the housing, since the keypad, together with the support, completely closes the opening in the housing. In this regard, it is advisable for the shoulder to be formed as a single piece with the housing, and for the shoulder to have a sealing rib which faces the edge of the keypad and which is formed as a single piece with the shoulder. The sealing rib engages the elastic edge and, in interaction with the retaining devices, increases the sealing effect.

It is advantageous if the extension is formed as a stem below the key on the inside of the keypad and passes through an opening in the support. For one thing, this produces reliable alignment of the keypad with the mounting plate located below it and thus with the switching elements, and, for another, the stem can act directly on the switching element and activate the electronics on the mounting plate. It is advantageous if the retaining devices have projections for gripping regions of the housing from behind, so that the support and the keypad can be securely held on the housing. In this regard, it is advisable for the retaining devices to be designed as elastic locking devices with tabs, which are arranged along the support to provide uniform loading of the support upon fastening.

It is especially advantageous if, during the process of inserting the assembly that consists of the support and keypad, the retaining devices first spring back and then, after the edge of the keypad has been compressed, spring into their retaining position. As a result of the fact that the edge is first compressed, and only then do the retaining devices act, it is ensured that the keypad is always securely fastened. If the latch projections cannot spring back, the keypad remains loose on the housing and this is visually obvious, so that the attachment operation must be repeated. It is advantageous for the peripheral edge of the keypad to have a U-shaped cross section to guarantee secure mounting and sealing of the support. In this regard, it is advisable for the clear separation of the two legs of the U-shaped edge to be as great as the height of a peripheral web of the support that faces in the direction of the keypad. In this way, the web of the support loads the keypad all around its edge, so that the keypad can be easily inserted, and the keypad and support form a pre-assembled unit.

In a special embodiment of the invention with a keypad that has several keys, reinforcement is provided between two keys. This reinforcement makes it possible to readily distinguish the individual keys when their switching movement is to be initiated. In this regard, it is advantageous for the reinforcement to take the form of thickening of the material, so that the individual keys themselves have a membrane-like form, while the edge around the individual keys is designed as thickened material. It is desirable to design the material thickening in the form of strips, so that these strips can fit into groove-like recesses in the support. A measure of this type results in exact alignment of the individual keys with the switching elements of the mounting plate, but still there is a clear demarcation of the individual keys.

To visually indicate even several keys of the keypad, a recess is provided on the upper side of the keypad support between two keys, which clearly bounds the individual keys of the keypad.

In this special embodiment, the recess can be designed as a groove and can have a decorative rib at least in certain regions, which simultaneously serves as a tactile ridge (tactile rib). This measure makes it possible to distinguish the individual keys even during the switching movement, since the reinforcing rib on the upper side provides an explanation that is easily felt in the flat surface. To obtain further improvement of the tactile features, it is advantageous to extend the reinforcing rib, which can be inserted in the recess, as far as the upper side of the housing in certain regions. The seal of the keypad in the housing is not impaired by all of these measures. A secure seal is produced by the support together with the keypad.

To allow the fastest possibly assembly and secure mounting, it is advisable that the housing have a web that runs completely around its periphery. The mounting plate rests on this web and can then be held on it together with the switching elements and the stems of the keypad. In addition, there is another compartment for holding such things as the power supply or other electronic or electrical components.

In a special embodiment of the invention, the housing is designed with two shells. The bottom shell holds the mounting plate, and the top shell has the opening with the control surface that can be covered by the keypad. This arrangement again provides secure mounting and a reliable construction, especially with respect to the design and sealing, since rectilinear edges or surfaces are provided at the places to be sealed.

BRIEF DESCRIPTION OF THE DRAWINGS

An embodiment of the object of the invention is shown in the drawings.

FIG. 2 shows a cross-sectional perspective view of the key housing.

FIG. 3 shows an enlarged section of a portion of the drawing in FIG. 2.

FIG. 4 shows the underside of the upper part of the key housing.

FIG. 6 shows a perspective exploded view of the upper side of the upper part of the key housing.

FIG. 7 shows a perspective exploded view of the underside of the upper part of the housing.

DETAILED DESCRIPTION OF THE INVENTION

The key housing 10 of the invention consists of a top shell 11 and a bottom shell 12.

Figure 1:
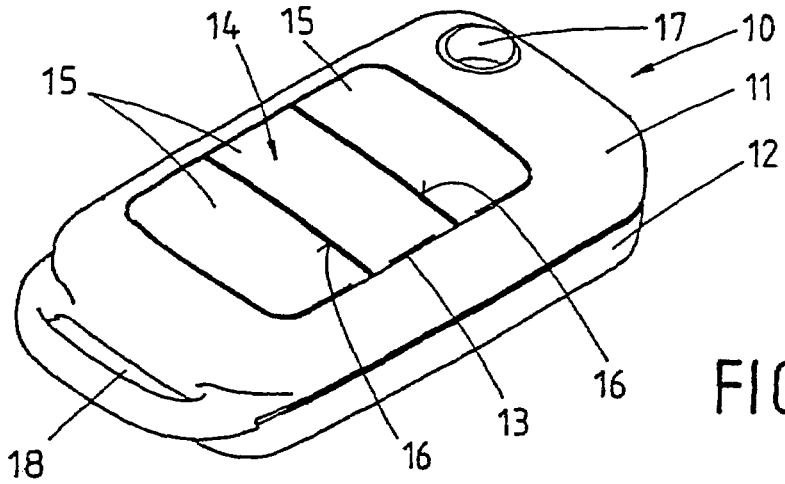
FIG. 1 shows a perspective view of the key housing with keypad.

The top shell 11 has a recess 13, in which a keypad 14 with individual keys 15 is inserted. The individual keys 15 are separated from one another by recesses 16. As FIG. 1 also shows, the housing 10 has an opening 17. The purpose of this opening is to hold a bearing pin of the mechanical key of the key housing. On the opposite end of the housing, there is a loop 18, by which the key housing can be attached, for example, to a key ring.

As FIG. 2 shows, the elastic keypad 14 has a U-shaped peripheral region 19. The free leg of the peripheral region is supported on a shoulder 28 of the top shell 11. The drawing also reveals that a stem 20 is formed on the inside of the keypad 14. When this stem is operated to activate a switching element 32 by pushing the elastic key 15 with the stem 20 against the switching element, the stem passes smoothly through an opening 29 in a support 21.

The U-shaped edge 19 of the keypad holds the edge 22 of the support 21 all around the periphery. In this regard, the edge of the support is provided with a web 23, which has about the same width as the U-shaped holding device, so that the edge of the keypad 14 is hardened relative to the rest of the area. The keypad itself is made of an elastic material and has the form of a membrane in the area of the keys.

The drawing shows that the shoulder 28 of the housing has a sealing rib 29. This sealing rib presses into the edge 19 of the keypad, when, during mounting, the edge is compressed and settles elastically on the shoulder.

The edge 22 of the support 21 supports locking devices 24, which are provided with a tab 25 and grip a retaining area 26 from behind for mounting.

During mounting, the assembly consisting of the support and keypad is pressed against the shoulder 28 of the top shell, which causes compression of the edge of the keypad, until the locking devices 24 spring back and then, finally, their tabs come to rest on the retaining area 26.

The only thing that remains to be added here is that the switching element 32 is provided on a mounting plate 31. The mounting plate is supported on the bottom shell and is pressed and held against the bottom shell by a peripheral projection 30 of the top shell. The peripheral projection 30 is clearly shown in FIG. 4. The mounting plate is furnished with additional electrical or electronic components, which are not explained in detail.

Finally, it should also be mentioned that the housing 10 has a compartment 33, which holds a mechanical key, which can be turned with a pin in the opening 17 and flipped out when needed.

The space 34 located below the mounting plate can be used to house additional components or the battery.

FIG. 4 clearly shows the locking devices 24 with their tabs 25 and especially how they engage the retaining area 26. The stems 20 pass through openings 27 and are located in the area of the switching elements 32.

Figure 5:
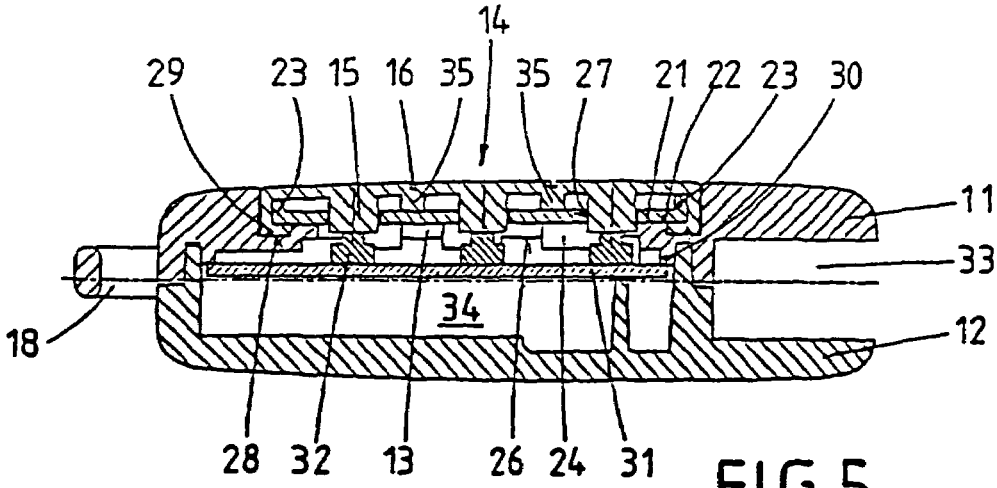
FIG. 5 shows a longitudinal section through the key housing.

Three keys 15 are provided in the present embodiment, for example, one key for opening the vehicle, one for locking it, and a third for opening, e.g., the trunk of a car. As FIGS. 2 and 5 show, the two facing regions of the top shell and bottom shell are labyrinthine in their construction, so that a tight seal is guaranteed after possibly an adhesive compound or a seal has been applied.

In the embodiment shown in FIG. 5, strip-like thickening devices 35 are provided below the recesses 16. They rest on the support 21 to obtain the membrane-like effect of the individual keys, since the key membrane 15 lies between two thickening devices 35 or within the peripheral web of the support.

FIGS. 6 and 7 show the individual parts of the top shell that are combined to form an assembly. The view of the underside of the keypad shows that the peripheral edge is thickened by its U-shaped design. The strip-like thickening devices are provided between the individual keys, while the operating stem is located in the center of the key. The thickening devices 35 are designed in such a way that they fit into groove-like recesses 36 of the web 23 of the support 21 and in this way produce alignment of the keypad with the support during assembly. The locking devices 24 with the locking tabs 25 are located on the underside of the support 21. The locking devices are lined up with the longitudinal sides of the rectangular opening 13 in the housing.

The aforementioned three parts, i.e., the keypad, support, and top shell, can be assembled and mounted as a unit. The peripheral U-shaped edge of the keypad is supported on the shoulder of the housing. During assembly, the strip-like thickening devices and the stems are aligned with the openings and the U-shaped recesses, and this unit can then be inserted in the opening in such a way that the tabs of the locking devices can catch behind the retaining areas (cf. FIG. 2 and FIG. 4).

As soon as this unit has been assembled, the top shell can be placed on the bottom shell, and then the peripheral projection 30 is supported on the upper edge of the mounting plate.

As has already been mentioned, the embodiment shown here is only an example of an implementation of the invention. The invention is not limited to this embodiment, but rather various modifications and applications are possible. To separate the individual keys of the keypad, wider grooves may also be used, in which case rod-shaped thickening devices can be inserted in the grooves, which even rest against the outer edge of the top shell in certain regions, so that it is possible, during operation, to feel the beginning and the end of the key. It is worth mentioning that the electrical design, including especially the transmitter or possibly the receiver of the key, is not shown.

| | |
|---|---|
| 10 | housing |
| 11 | top shell |
| 12 | bottom shell |
| 13 | recess in 11 |
| 14 | keypad |
| 15 | key |
| 16 | recesses |
| 17 | opening |
| 18 | loop |
| 19 | U-shaped edge of 13 |
| 20 | stem on 15 |
| 21 | support |
| 22 | edge of the support |

-continued

| | |
|---|---|
| 23 | web of 22 |
| 24 | locking device |
| 25 | tab of 24 |
| 26 | retaining area for 24 |
| 27 | opening |
| 28 | shoulder on 11 |
| 29 | sealing rib on 28 |
| 30 | peripheral projection on the underside of 11 |
| 31 | mounting plate |
| 32 | switching element |
| 33 | compartment for key |
| 34 | space beneath the mounting plate |
| 35 | thickening device |
| 36 | U-shaped recesses on the underside of 21 |

The invention claimed is:

1. Housing for an electronic or mechanical key, with electrical and electronic components (32) inside the housing, wherein at least some of which are arranged on a mounting plate (31), and with an opening in the housing, which can be covered by an elastic keypad (14) having at least one key (15) wherein the key (15), on a side thereof facing the mounting plate (31), is provided with an extension, by which a component on the mounting plate that is designed as a switching element can be operated, wherein the keypad (14) has a support (21) for mounting on the housing (10), that the keypad (14) has a peripheral elastic edge (19) that grips the support (21) located below the keypad, and wherein the elastic edge (19) is supported on a shoulder (28) of the housing (10), wherein the elastic edge (19) is compressed against the shoulder (28) of the housing by retaining devices (24, 25) to produce a tight seal.

2. Key housing in accordance with claim 1, wherein the shoulder (28) is formed as a single piece with the housing and the shoulder (28) has a sealing rib (29) which faces the edge of the keypad (14) and which is formed as a single piece with the shoulder.

3. Key housing in accordance with claim 1, wherein the extension is formed as a stem (20) below the key (15) on an inside of the keypad (14) and extends through an opening (27) in the support (21).

4. Key housing in accordance with claim 1, wherein the retaining devices have tabs (25) that grip areas (26) of the housing (10) from behind.

5. Key housing in accordance with claim 4, wherein, in cross section, the areas (26) that are gripped from behind by the retaining devices (24) used to mount the keypad are arranged at a distance from the shoulder (28) that supports the edge (19).

6. Key housing in accordance with claim 1, wherein the retaining devices are elastic locking devices (24) with locking tabs (25).

7. Key housing in accordance with claim 1, wherein, when inserting an assembly that consists of the keypad (14) and support (21), the retaining devices (24, 25) first spring back and then, after the edge (19) of the keypad has been compressed, spring into a retaining position behind the retaining area (26).

8. Key housing in accordance with claim 1, wherein the peripheral elastic edge (19) of the keypad (14) has a U-shaped cross section.

9. Key housing in accordance with claim 1, wherein the elastic edge (19) is U-shaped with two legs, wherein a gap between the two legs of the U-shaped edge (19) of the keypad (14) is as great as a height of a peripheral web (23) of the support (21) that faces the keypad (14).

10. Key housing in accordance with claim 1, wherein when the keypad (14) has several keys (15), further comprising reinforcement (35) between two keys (15).

11. Key housing in accordance with claim 10, wherein the reinforcement is comprised of a material thickening (35).

12. Key housing in accordance with claim 11, wherein the material thickening (35) is comprised of strips, which fit into groove-like recesses (36) of the support (21).

13. Key housing in accordance with claim 1, wherein a recess (16) is provided on an upper side of the keypad (14) between two keys (15).

14. Key housing in accordance with claim 13, wherein the recess (16) is a groove and has a reinforcing rib at least in certain regions.

15. Key housing in accordance with claim 14, wherein the reinforcing rib, which can be inserted in the recess, extends as far as the upper side of the housing in certain regions.

16. Key housing in accordance with claim 1, wherein the housing comprises a bottom shell (12) that holds the mounting plate (31) and a top shell (11) that has the opening (13) that can be covered by the keypad (14).

17. Key Housing in accordance with claim 16, wherein the mounting plate is pressed onto the bottom shelf (12) by a peripheral projection (30) of the top shelf (11).

* * * * *